US009079408B2

(12) United States Patent
Suzuki et al.

(10) Patent No.: US 9,079,408 B2
(45) Date of Patent: Jul. 14, 2015

(54) INK JET PRINTING APPARATUS AND MAINTENANCE METHOD

(71) Applicant: CANON KABUSHIKI KAISHA, Tokyo (JP)

(72) Inventors: Seiji Suzuki, Ebina (JP); Shunya Sunouchi, Machida (JP); Takaya Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 147 days.

(21) Appl. No.: 13/650,314

(22) Filed: Oct. 12, 2012

(65) Prior Publication Data

US 2013/0100199 A1 Apr. 25, 2013

(30) Foreign Application Priority Data

Oct. 21, 2011 (JP) ..... 2011-231275

(51) Int. Cl.
*B41J 2/165* (2006.01)
*B41J 2/175* (2006.01)
*B41J 2/18* (2006.01)

(52) U.S. Cl.
CPC ..... *B41J 2/16585* (2013.01); *B41J 2/17596* (2013.01); *B41J 2/18* (2013.01)

(58) Field of Classification Search
None
See application file for complete search history.

(56) References Cited

U.S. PATENT DOCUMENTS

| | | | | |
|---|---|---|---|---|
| 6,149,261 | A | 11/2000 | Kuwabara et al. | |
| 6,302,516 | B1 | 10/2001 | Brooks et al. | |
| 6,491,365 | B2 * | 12/2002 | Sonobe | 347/22 |
| 6,719,400 | B2 | 4/2004 | Inui et al. | |
| 8,061,805 | B2 | 11/2011 | Suzuki et al. | |
| 2004/0137159 | A1 | 7/2004 | Nakamura et al. | |
| 2010/0033531 | A1 | 2/2010 | Suzuki et al. | |
| 2010/0321425 | A1 * | 12/2010 | Kanke et al. | 347/6 |

FOREIGN PATENT DOCUMENTS

| | | | |
|---|---|---|---|
| CN | 1214012 | A | 4/1999 |
| CN | 1498688 | A | 5/2004 |
| EP | 1025997 | A2 | 8/2000 |
| JP | 2002-019139 | A | 1/2002 |
| WO | 2009/049135 | A1 | 4/2009 |

* cited by examiner

*Primary Examiner* — Alejandro Valencia
(74) *Attorney, Agent, or Firm* — Fitzpatrick, Cella, Harper & Scinto

(57) ABSTRACT

Even when a pressurizing operation is performed, degradation of the quality of a printing head due to wiping of a nozzle surface is suppressed. In an ink jet printing apparatus including a printing head, an ink tank, a first pump arranged in an ink supplying path for supplying ink from the ink tank to the printing head, a second pump arranged in an ink collecting path for collecting ink from the printing head to the ink tank, a switch valve arranged between the printing head and the second pump, and a cleaning mechanism, by driving the first pump in a state where the switch valve is closed, the ink is discharged from the nozzle row, and after driving of the second pump in a state where the switch valve is opened, the cleaning mechanism is caused to clean the printing head.

4 Claims, 11 Drawing Sheets

INK JET PRINTING APPARATUS AND MAINTENANCE METHOD

BACKGROUND OF THE INVENTION

1. Field of the Invention

The present invention relates to an ink jet printing apparatus and a maintenance method for the printing apparatus, and in particular, an ink jet printing apparatus and a maintenance method for the printing apparatus, which perform a nozzle recovery operation by pressurizing the inside of a printing head.

2. Description of the Related Art

In an ink jet printing apparatus, degradation of the printing quality may be caused due to improper ink ejection. This is because clogging is caused by thickening or adhesion of dried ink in a nozzle ejecting ink, or by mixture of paper powders, dusts, air bubbles or the like into the ink in the nozzle. Accordingly, in order to suppress the improper ink ejection caused by these factors, maintenance of a printing head is needed.

In order to suppress such improper ink ejection, there is known a maintenance method of providing a pressurizing unit in an ink supplying path to pressurize the inside of the printing head, thereby discharging the ink in the head and removing foreign substances, air bubbles and the like in the printing head (Refer to, for example, Japanese Patent Laid-Open No. 2002-19139).

However, in a line-type printing head, after a pressurizing operation, a large amount of ink may remain on a surface of the nozzle. The remaining ink is removed by a wiping operation using a blade and a suction unit.

However, in the case where the ink on the surface of the nozzle needs to be sufficiently removed, a large number of times of the wiping operation is required. As the number of times of the wiping operation increases, a maintenance time becomes longer, and for example, when the pressurizing operation is performed prior to a printing operation, a time required to start printing increases and thus, the time when the printing is completed becomes late. Furthermore, by the fact that the number of times of the wiping operation is large, the durability of the printing head may not be kept, having a negative effect on the quality of an image.

SUMMARY OF THE INVENTION

The present invention has been made in consideration of the above-mentioned matters, and its object is to provide an ink jet printing apparatus and a maintenance method, which can suppress degradation of the quality of the printing head due to wiping of the surface of the nozzle even when the pressurizing operation is performed.

Therefore, according to the present invention, an ink jet printing apparatus comprising: a printing head having a nozzle row ejecting ink; an ink tank storing ink supplied to the printing head; a first pump arranged in an ink supplying path for supplying ink from the ink tank to the printing head; a second pump arranged in an ink collecting path for collecting ink from the printing head to the ink tank; a switch valve arranged between the printing head and the second pump; and a cleaning mechanism moving in a direction of the nozzle row and cleaning the printing head, wherein by driving the first pump in a state where the switch valve is closed, the ink is discharged from the nozzle row, and after driving of the second pump in a state where the switch valve is opened, the cleaning mechanism is caused to clean the printing head.

With such configuration, by pressurizing the printing head and causing the ink to be discharged from the printing head, a negative pressure is generated in the printing heads. As a result, in a recovery operation of the printing head, the amount of ink remaining on the nozzle surface after discharge from the printing head under pressure is decreased. Accordingly, the number of times of the wiping operation of the nozzle surface can be reduced, thereby suppressing degradation of the printing head due to wiping.

Further features of the present invention will become apparent from the following description of exemplary embodiments (with reference to the attached drawings).

DESCRIPTION OF THE EMBODIMENTS

An embodiment of the present invention will be described below with reference to figures.

Figure 1:
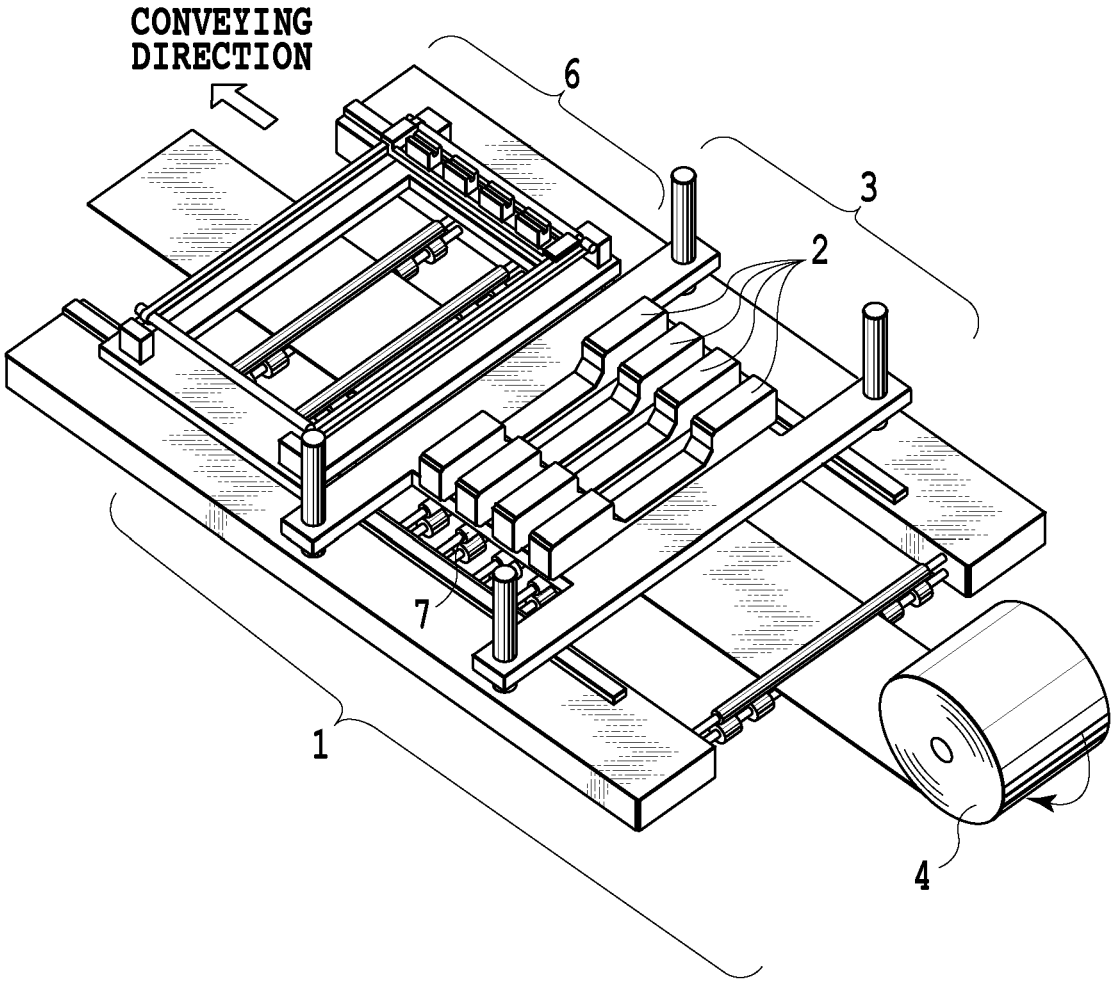
FIG. 1 is a schematic perspective view showing a state at the time of printing of an ink jet printing apparatus in an embodiment.

FIG. 1 is a schematic perspective view showing a state at the time of printing of an ink jet printing apparatus in the embodiment. The printing apparatus in the embodiment is a printing apparatus using an ink jet method, and is a high-speed line printer that uses a continuous printing medium wound in the form of a roll and addresses both of one-sided printing and both-sided printing. The printing apparatus in the embodiment is suitable for a printing field of mass-printing, for example, in a print laboratory and the like.

A printing apparatus 1 includes a printing unit 3 having a plurality of printing heads 2, and the printing heads 2 apply ink droplet on a printing medium 4 to form an image on the printing medium 4. The printing heads 2 is made up of four printing heads storing each of inks of CMYK. Meanwhile, although the printing heads 2 in the embodiment are constituted by the four printing head storing each of the four colors CMYK, the printing heads according to the present invention are not limited to these. That is, the printing heads may use ink of three colors or ink of four or more colors and may be constituted by the printing heads filling respective colored inks. In addition, although the printing heads 2 constituted by the four printing heads are used in the embodiment, the present invention is not limited to such printing heads, and may be one printing head provided with ink tanks for multiple colors.

The printing heads 2 is integrally held by a head holder 5, and the head holder 5 can be vertically moved such that a distance between the printing unit 3 and a printing surface of the printing medium can be changed. On the most upstream side of the printing apparatus 1, a sheet supplying unit (not shown) setting the printing medium 4 in a roll state is provided, and a sheet supplying mechanism (not shown) including a conveying roller 7 that conveys the printing medium 4 to the printing heads 2 at a predetermined speed in the printing operation is also provided. Here, the printing medium 4 applied to the printing apparatus according to the present invention is not limited to the continuous printing medium wound in the form of a roll, and a cut sheet may be applied.

Figure 2:
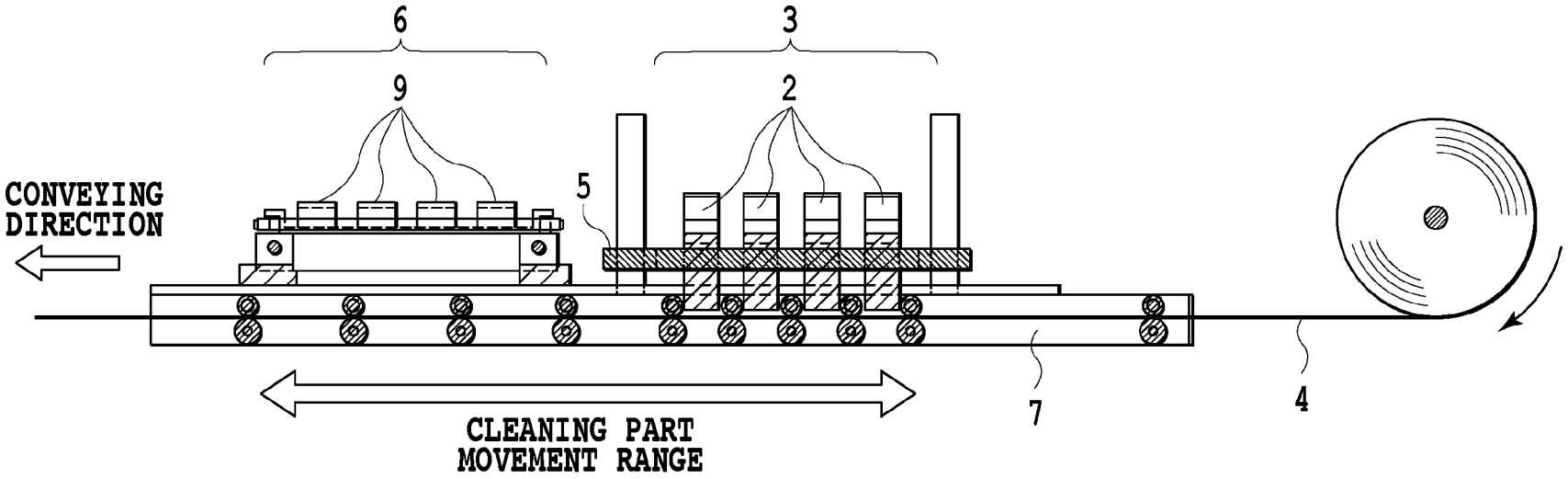
FIG. 2 is a schematic cross-sectional view showing a cross-sectional structure of the printing apparatus shown in FIG. 1.
Figure 3:
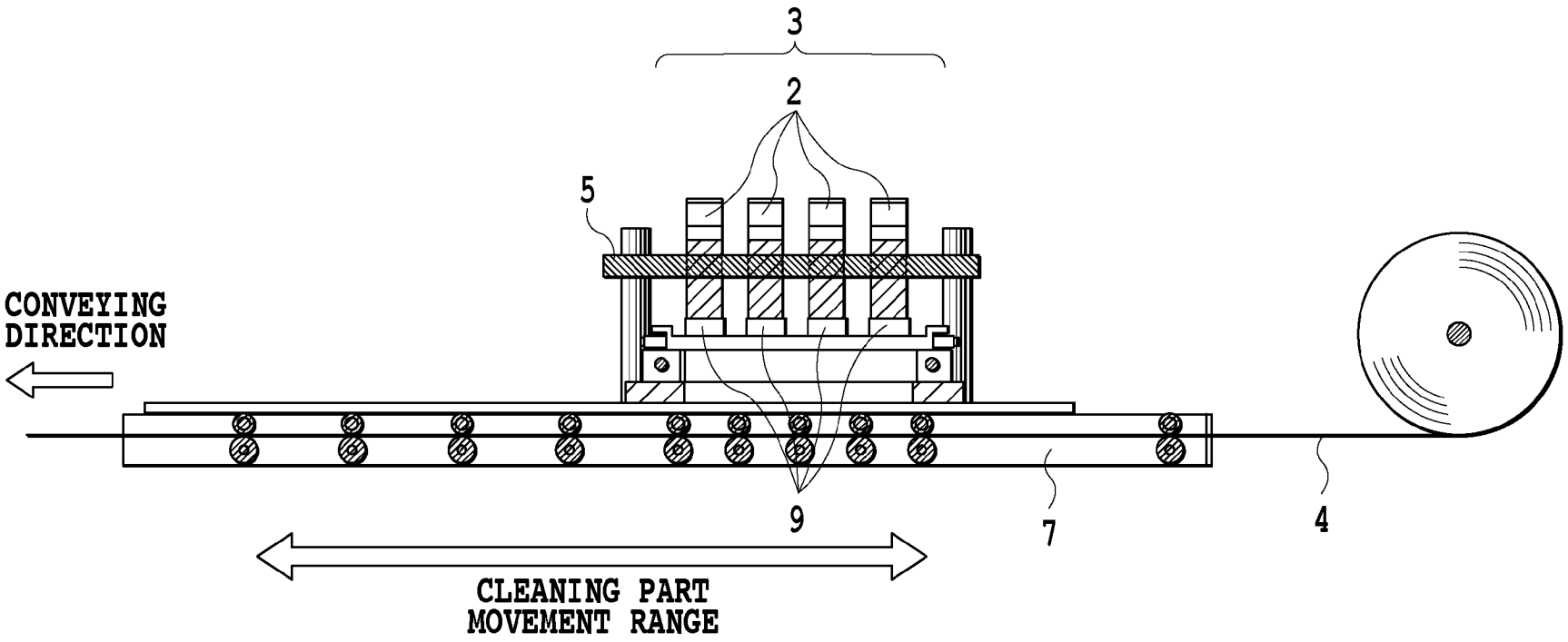
FIG. 3 is a schematic cross-sectional view showing the cross-sectional structure of the printing apparatus shown in FIG. 1.

FIGS. 2 and 3 are schematic cross-sectional views showing a cross-sectional structure of the printing apparatus shown in FIG. 1. A cleaning unit 6 is provided downstream of the printing unit 3 to clean a plurality of ink nozzles 38 provided in the printing heads 2 through the use of wiping mechanism part 9. The cleaning unit 6 can move in a printing medium conveying direction, and as shown in FIG. 2, moves immediately below the printing heads 2 at the time of performing a cleaning operation.

Figure 4:
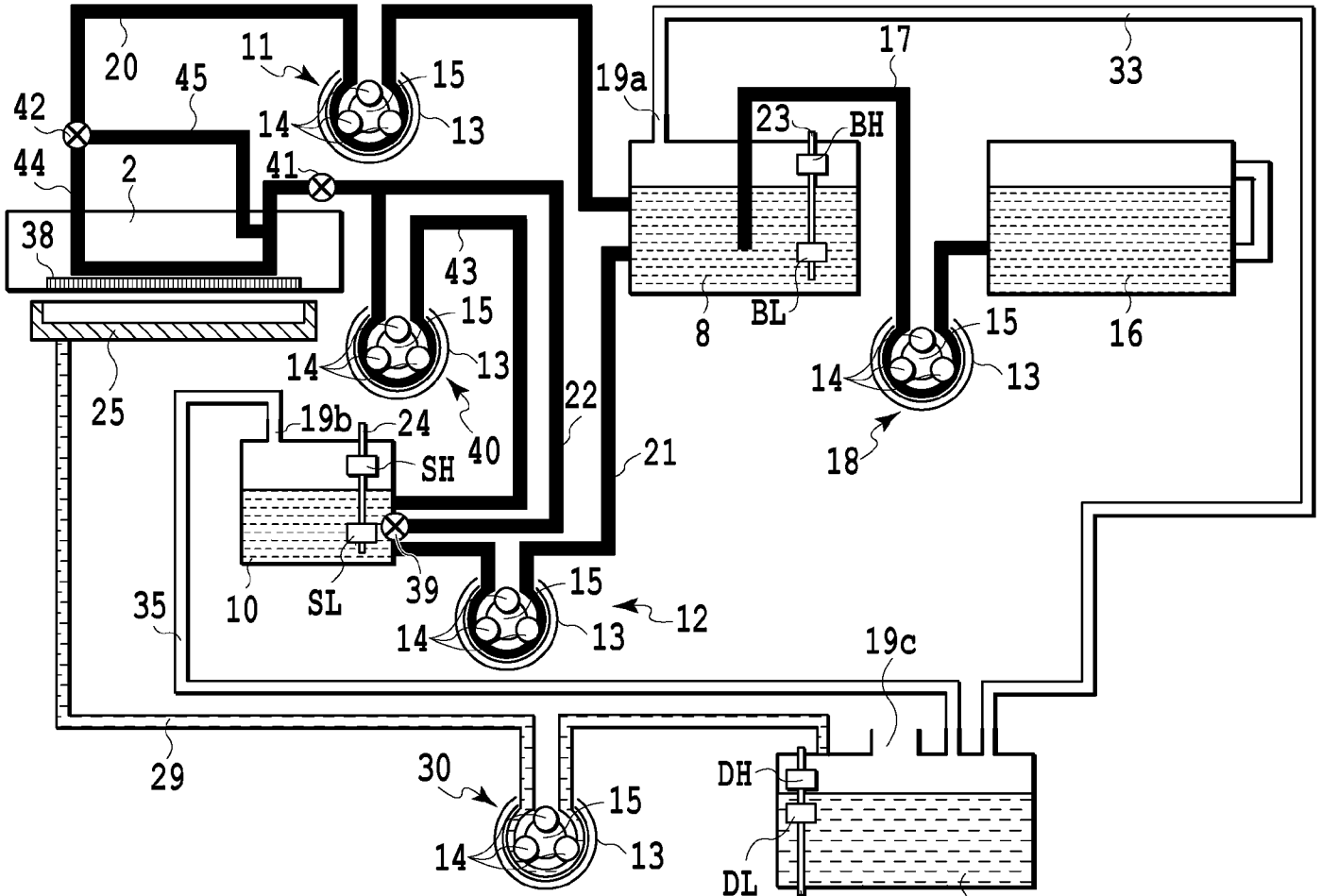
FIG. 4 is a schematic overall configuration view showing the printing apparatus in the embodiment.
Figure 5:
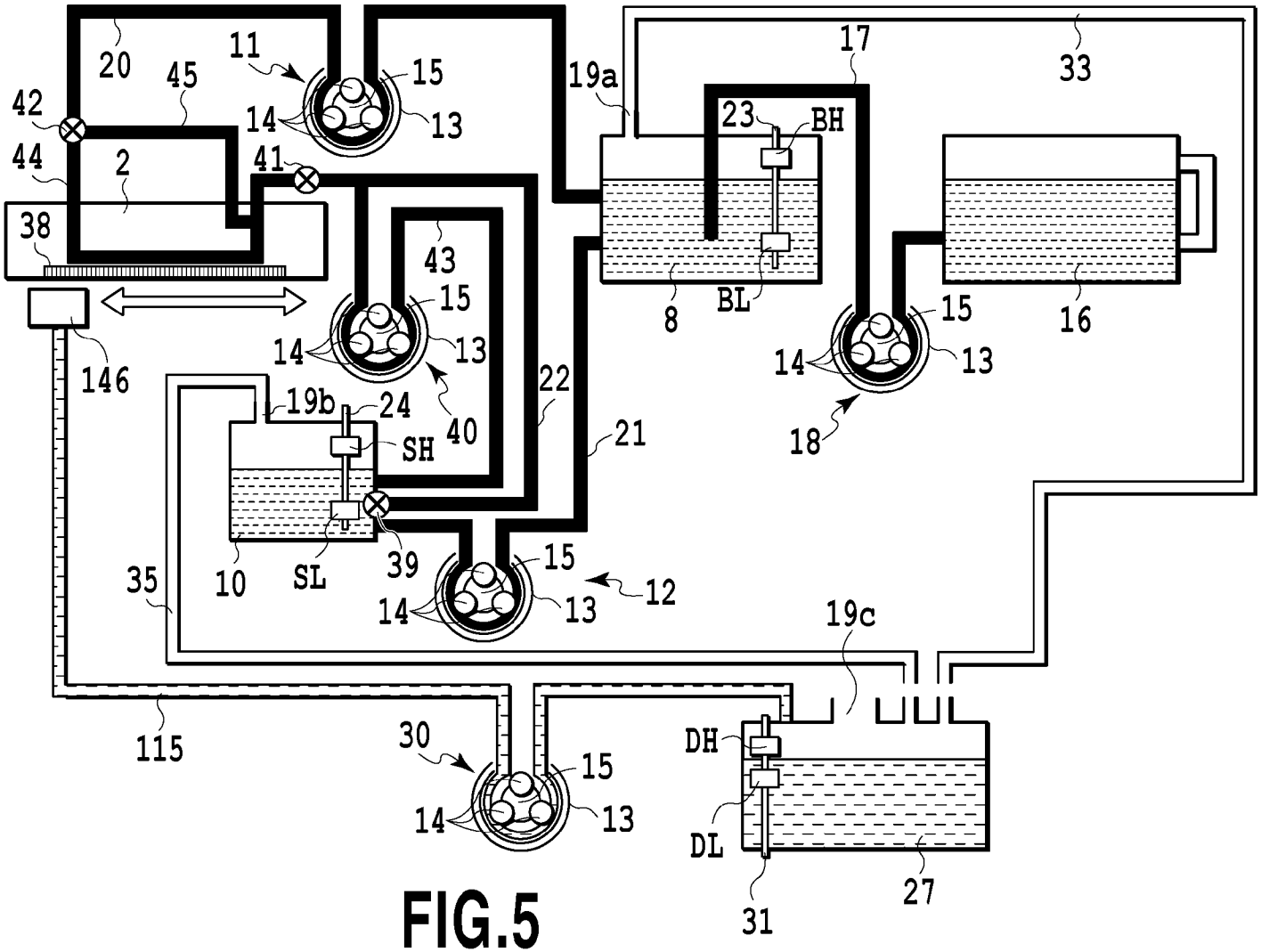
FIG. 5 is a schematic overall configuration view showing the printing apparatus in the embodiment.

FIGS. 4 and 5 are schematic overall configuration views showing the printing apparatus in the embodiment. First, a basic configuration of an ink circulation supplying path in the embodiment will be described. The ink circulation supplying path is constituted by an ink supplying path and an ink collecting path. A path for supplying ink from an ink tank to the printing head is referred to as the ink supplying path, and a path for collecting ink from the printing head to a buffer tank is referred to as the ink collecting path.

A buffer tank 8 that is a first ink storing part is provided on an ink flowing side of the printing heads 2. Moreover, subsequent to the buffer tank 8, a sub tank 10 that is a second ink storing part is provided. The printing heads 2 are arranged beyond the sub tank 10. In this way, an ink circulation path is formed within the printing apparatus 1.

The printing heads 2 are provided with an in-head path 44, and a bypass path 45 shortcutting without passing through the in-head path. A first switch valve 42 formed of a switch valve mechanism for selecting and closing the in-head path 44 and the bypass path 45 is provided between the printing heads 2 and the buffer tank 8, and, beyond that, is connected to a first circulating tube 20, and a first circulating pump 11 is provided in the middle of the tube 20. Furthermore, the buffer tank 8 is connected to the sub tank 10 via a second circulating tube 21, and a second circulating pump 12 is provided in the middle of the tube 21. The sub tank 10 is connected to the printing heads 2 via a third circulating tube 22, and second and third switch valve 39 and 41 for opening/closing the path are provided at both respective ends of the path. The first and second circulating pumps 11 and 12 employ a tube pump method capable of generating positive and negative pressures by rotatably driving the tube in forward and reverse directions while squeezing the tube between a pump guide part 13 and a pump roller 14. A motor (not shown) such as a stepping motor is used as a driving source, and the configuration is such that a pump roller holder 15 supporting the pump roller 14 and being rotatably held, is rotatably driven.

By simultaneously driving the first and second circulating pumps 11 and 12, an ink circulating operation is performed among the buffer tank 8, the sub tank 10, and the printing heads 2 via the above-mentioned ink circulating path. Furthermore, the ink in the printing heads 2 arbitrarily selects the in-head path 44 or the bypass path 45 by the first switch valve 42 and circulates. Furthermore, the sub tank 10 is connected to the printing heads 2 via a fourth circulating tube 43, and a third circulating pump 40 is provided in the middle of the tube 43.

In addition, an ink tank 16 is an ink container that supplies and resupplies ink into the printing apparatus 1, and is configured to be able to be detached from the printing apparatus 1. The ink tank 16 is connected to the printing apparatus 1 through a supplying tube 17. A supplying pump 18 adopting the tube pump method, just like the circulating pumps 11 and 12, is provided in the middle of the tube 17. The ink in the ink tank 16 is configured so as to be connected and supplied to the buffer tank 8.

Air communicating ports 19*a* and 19*b* are provided above the buffer tank 8 and the sub tank 10, respectively, and air bubbles collected in each tank can be discharged to the outside at all times. Moreover, the ports are configured so as to suppress breaking of meniscus in the ink nozzles 38 of the printing heads 2 and to suppress generation of ink dripping and flow-in of air bubbles, due to changes in temperature and outside atmospheric pressure, or a change in the pressure in the tanks at the time of the ink circulation via the printing heads 2.

Furthermore, regardless of whether ink circulation is performed or not, the sub tank 10 is arranged at the level where a balance between the pressure in the flow path and the pressure caused by head difference is kept, such that ink dripping and flow-in bubbles do not occur in the ink nozzles 38 of the printing heads 2 even when the head holder 5 holding the printing heads 2 vertically moves because they shift to a printing state, a capping state and the like.

Moreover, in order to control the amount of ink stored in the tank units, the buffer tank 8 and the sub tank 10 each have an ink-level detecting unit. The buffer tank 8 is provided with a float sensor 23 that is a first liquid-level detecting unit configured to detect the inner ink level. The float sensor 23 has circular tube-like upper and lower floats BH and BL each having a magnet therein, and a reed switch (not shown) is provided in a shaft penetrating and supporting the floats BH and BL. The configuration is such that each of the floats BH and BL is displaced in their height direction according to the amount of ink in the tank to switch ON/OFF the reed switch in the shaft, and the amount of ink in the tank is determined based on the ON/OFF state of the reed switch. Just like the buffer tank 8, the sub tank 10 is provided with a float sensor 24 as a second liquid-level detecting unit. The float sensor 24 has upper and lower floats SH and SL. It should be noted that, hereinafter, the embodiment will be described by using the float sensors 23 and 24. However, the liquid-level detecting unit is not limited to these sensors, and may be capacitance sensors detecting presence/absence of liquid on the basis of a capacitance value, ultrasound sensors that emits ultrasound wave to the liquid surface and detects presence/absence of reflected wave and arrival time of the reflected wave, or optical sensors that emits light from a light-emitting element and detects presence/absence of liquid based on whether or not the emitted light is full-reflected by a light-receiving element. Furthermore, although the number of liquid-level detecting parts in each tank is set to two in the embodiment, the number may be three or more, and may be changed depending on the tank. Moreover, the liquid level may be configured to be linearly detected. In addition, a unit configured to detect the amount of ink in the tank is not required to be limited to detection of the liquid level, and for example, there may be used unit configured to detect a change in the amount of liquid in the tank, by a change in weight, through the use of a weight sensor or the like.

Next, a basic configuration of an ink discharge path in the embodiment will be described. The cleaning unit 6 is provided with a cap 25 sealing the ink nozzles 38 at the time of non-printing and suppressing improper ink ejection or the like. A drain tank 27 as an ink collecting part that is configured so as to be able to be detached from the printing apparatus 1 is provided beyond the cap 25, and the drain tank constitutes the ink discharge path. Here, since the drain tank 27 is a collecting part of waste ink and mixture of ink of different colors in the tank does not present a problem, a plurality of drain tanks for colors is not required and one tank common to all colors may be sufficient. However, so far as space permits, the plurality of drain tanks may be configured to be provided.

A valve mechanism (not shown) is provided at a connection of the printing apparatus 1 and the drain tank 27. The configuration is such that, while the drain tank 27 is attached to the printing apparatus 1, the valve mechanism (not shown) is opened and the drain tank 27 communicates with the printing apparatus 1. The configuration is such that, when the drain tank 27 is detached from the printing apparatus 1, the valve mechanism (not shown) is sealed, thereby sealing the connection of the printing apparatus 1 and the drain tank 27 to prevent ink leakage. Moreover, the cap 25 is connected to the drain tank 27 via a discharge tube 29, and a discharge pump 30 adopting the tube pump method, just like the circulating pumps 11 and 12, and the supplying pump 18, is provided in the middle of the discharge tube 29. With such configuration of the ink discharge path, waste ink ejected from the plurality of ink nozzles 38 provided in the printing heads 2 (for example, preliminary ink ejection between printings) is received by the cap 25. Then, by driving the discharge pump 30 with a driving source (not shown), the waste ink accumulating in the cap 25 can be discharged to the drain tank 27. Just like the buffer tank 8 and the sub tank 10, the drain tank 27 is provided with a float sensor 31 as a third liquid-level detecting unit. The float sensor 31 is configured to have upper and lower floats DH and DL. However, just like the float sensor 23 and 24, this liquid-level detecting unit is not limited to this configuration.

Figure 6:
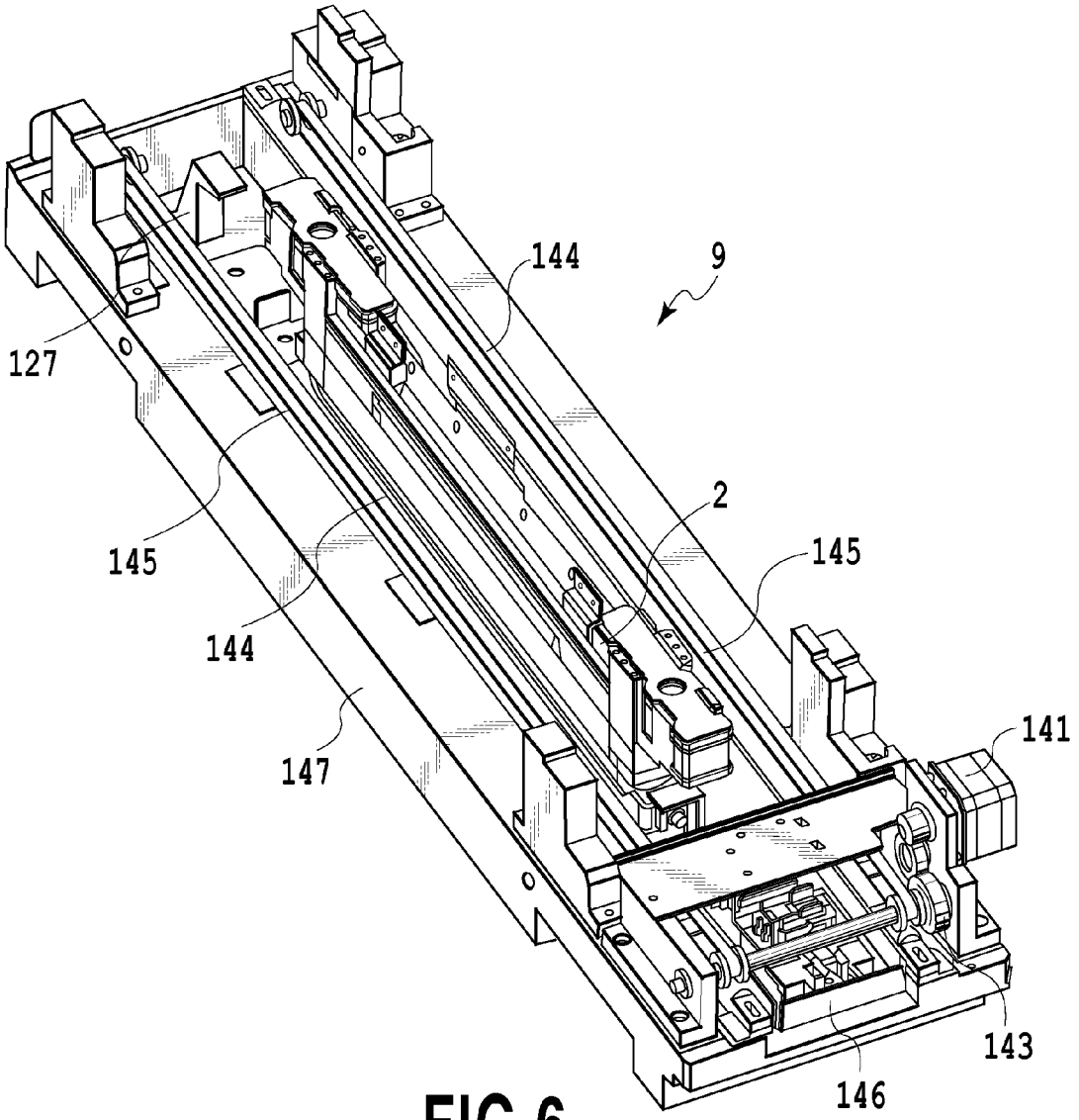
FIG. 6 is a perspective view showing a detailed configuration of a cleaning unit and a cleaning mechanism in the embodiment.
Figure 7:
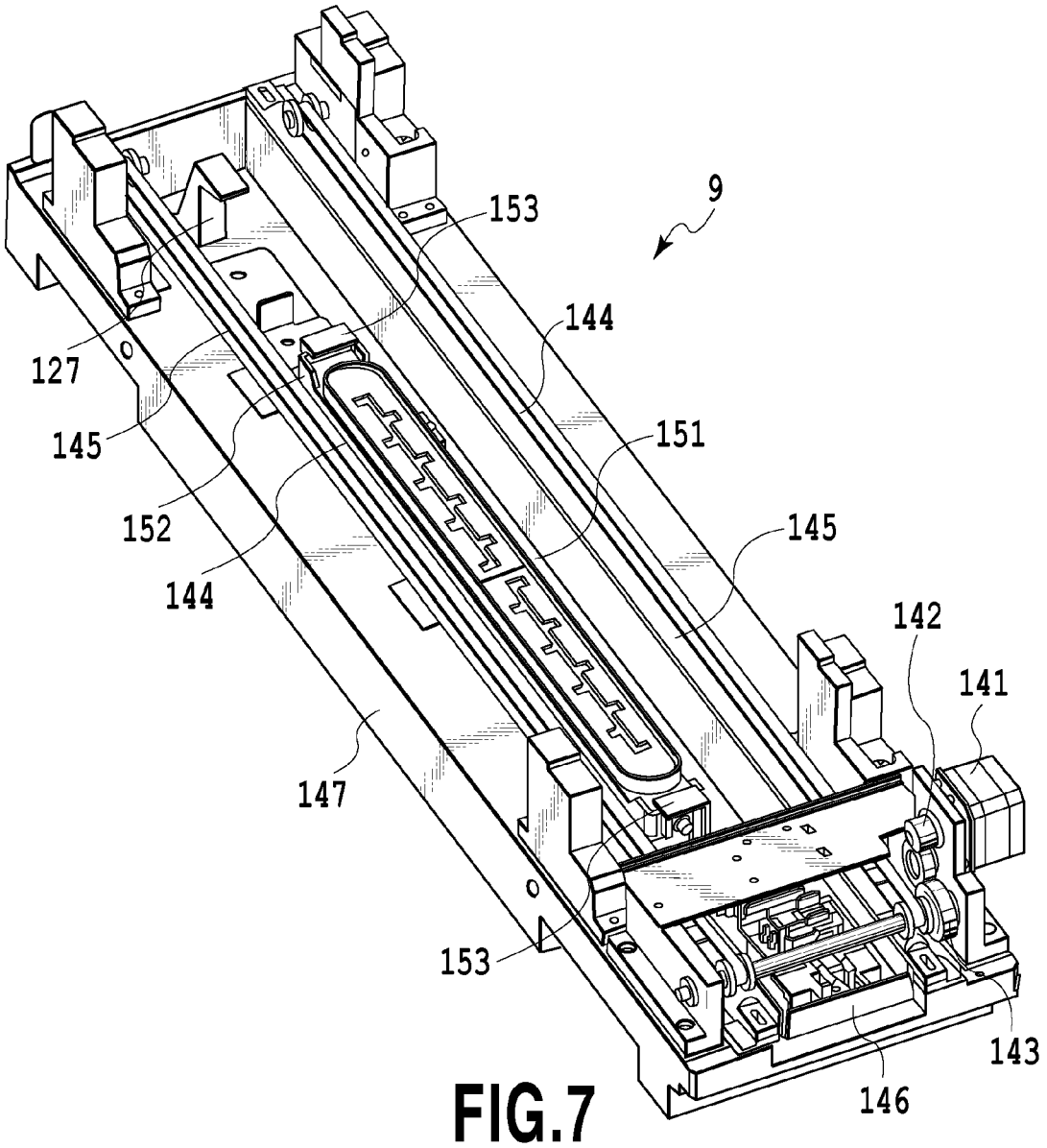
FIG. 7 is a perspective view showing the detailed configuration of the cleaning unit and the cleaning mechanism in the embodiment.

FIGS. 6 and 7 are perspective views showing a detailed configuration of the cleaning unit 6 and one cleaning mechanism 9 in the embodiment. FIG. 6 shows a state where the cleaning mechanism is located below the printing head (in the cleaning operation), and FIG. 7 shows a state where the cleaning mechanism is not located below the printing head.

The cleaning mechanism 9 includes a wiper unit 146 wiping ink and dusts adhering to nozzle surfaces of the printing heads 2, a transfer mechanism transferring the wiper unit 146 in a wiping direction (second direction), and a frame 147 integrally supporting these parts. The wiper unit 146 is a movable unit having below-mentioned blade and suction port. The transfer mechanism transfers the wiper unit 146 guided and supported by two shafts 145 in the second direction by driving of a driving source. The driving source has a driving motor 141 and reduction gears 142 and 143, and rotates a drive shaft 137. Rotation of the drive shaft 137 is transmitted through a belt 144 and a pulley, and transfers the wiper unit 146. As described below, the wiper unit 146 removes ink and dusts on the nozzle surfaces of the printing heads 2 by a combination of blades and suction ports. A trigger lever 127 is provided in order to switch the orientation of blades 121, outside a wiping area of the frame 147.

In FIG. 7, the cap 25 is held by a cap holder 152. The cap holder 152 is biased in a direction perpendicular to the nozzle surface of the printing head 2 by a spring as an elastic body, and can move against the spring. In a state where the frame 147 is located at a capping position, the printing heads 2 moves in the direction perpendicular to the nozzle surfaces to be close contact with or separated from the cap 25. By capping the nozzle surfaces through intimate contact, drying of the nozzles is suppressed.

Figure 8:
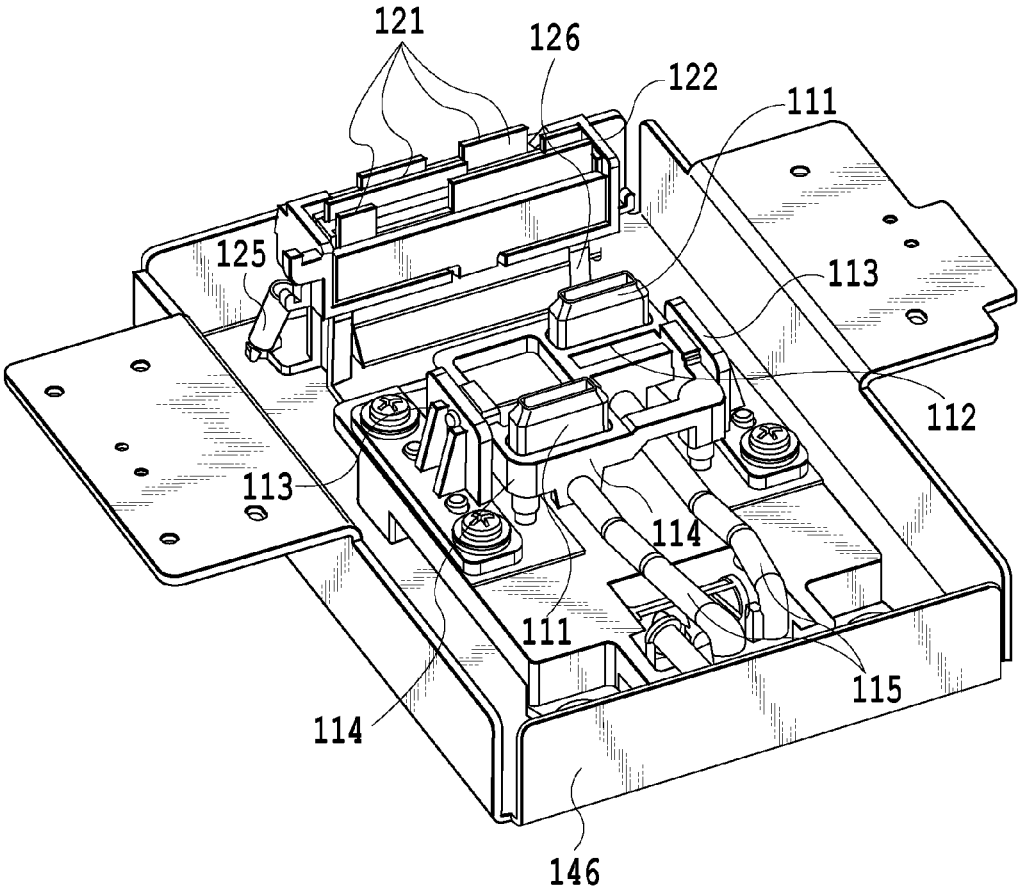
FIG. 8 is a view showing a configuration of a wiper unit in the embodiment.

FIG. 8 is a view showing a configuration of the wiper unit 146 in the embodiment. Two suction ports 111 (first and second suction unit) corresponding to the first and second nozzle rows are provided. The suction ports 111 is held by a suction holder 112, and the suction holder 112 is biased in a direction perpendicular to the nozzle surface of the printing head 2 (third direction) by a spring 114 as an elastic body, and can move in the third direction against the spring. That is, suction holder 112 is supported by a displacing mechanism that proceeds straight in a direction of a gap between the nozzle surfaces and the printing medium (third direction) and that has an elastic body.

Tubes 115 are connected to the two respective suction ports 111 via the suction holder 112, and a negative pressure generating unit such as a pump is connected to each of the tube 115. When the negative pressure generating unit is operated, negative pressure for sucking ink and dusts is given in the suction ports 111. The blades 121 are held by a blade holder 122. The blade holder 122 is supported at its both ends in a first direction, and is configured so as to be able to be rotated about the first direction as a rotational axis. The blades 121 can switch the height between a wiping position and a retracted position. The suction holder 112 and the blade holder 122 are installed on a common supporting body of the wiper unit 146.

Figure 9A:
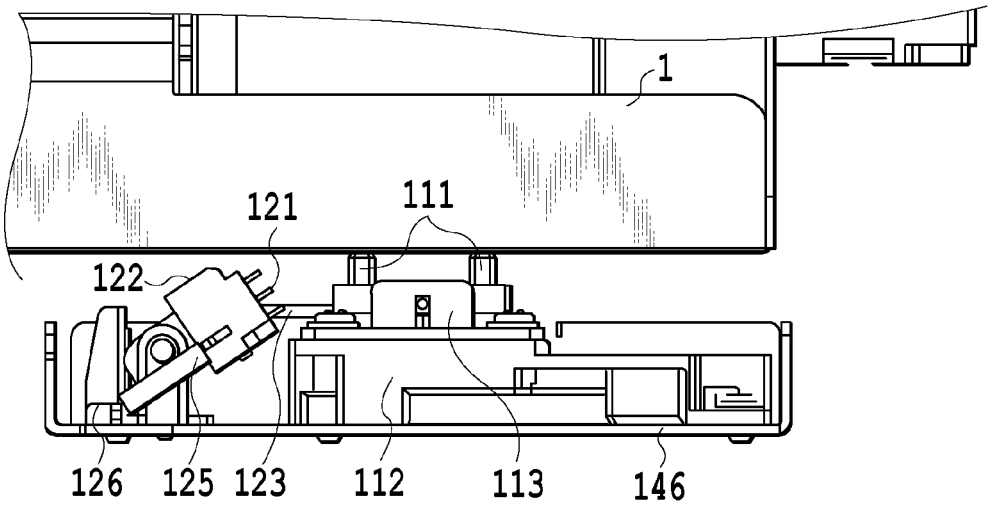
FIGS. 9A and 9B are side views showing the cleaning mechanism in the embodiment.
Figure 9B:
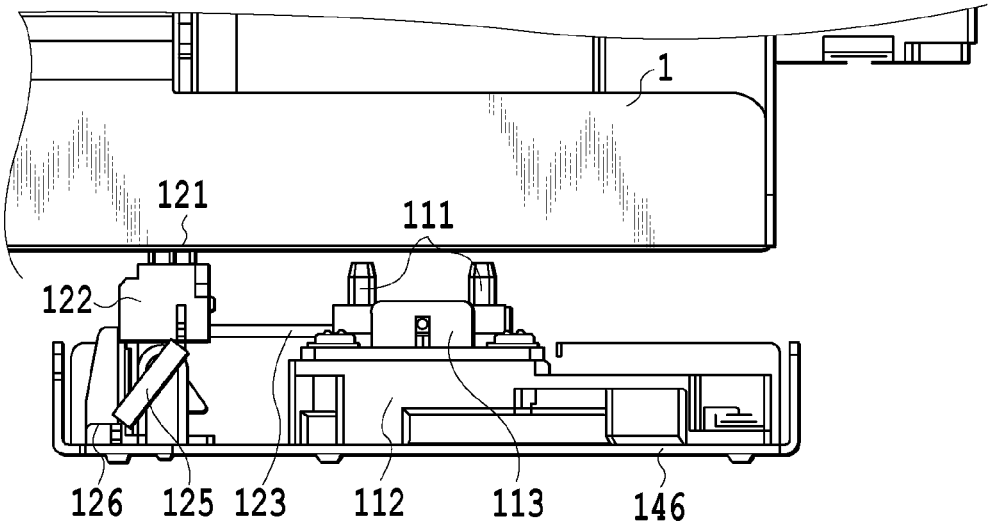

FIGS. 9A and 9B are side views showing the cleaning mechanism in the embodiment. FIG. 9A shows a state of a suction mode of cleaning the printing head 2 by the suction ports 111. FIG. 9B shows a state of a wiping mode of cleaning the printing head 2 by the blades 121.

In the suction mode, as shown in FIG. 9A, the blades 121 are located at the retracted position. In this state, a tip of the blade 121 is positioned farther away from the nozzle surface of the printing head 2 than a tip of the suction port 111. The position of the printing head 2 in the third direction (position in the suction mode) is set and kept such that the tip of the suction port 111 contacts the nozzle surface of the printing head 2. When the wiper unit 146 is moved in the second direction while a negative pressure is generated in the suction ports 111 by the negative pressure generating unit, ink and dusts adhering to the nozzles can be sucked by the suction ports 111 for removal.

In contrast, in the wiping mode, as shown in FIG. 9B, the blades 121 are switched to the wiping position. The position of the printing head 2 in the third direction (position in the wiping mode) is set and kept such that the tip of the blade 121 properly contacts the nozzle surface of the printing head 2. At this time, the tip of the suction port 111 is separated farther away from the nozzle surface of the printing head 2 than the state shown in FIG. 9A. The negative pressure generating unit is stopped. When the wiper unit 146 is moved in the second direction, the blades 121 makes it possible to wipe out ink and dusts for removal, by wiping the nozzle surfaces.

As described above, the cleaning mechanism relatively moves the cleaning mechanism section in the arrangement direction of the nozzles of the printing heads. The cleaning mechanism has the two modes: the suction mode and the wiping mode, and can selectively perform either mode by using the same wiper unit 146. For example, the ink ejecting state of the nozzles is determined, and the proper mode is selected based on a determination result. Specifically, when it is determined that ejection failure nozzle does not exist, the wiping mode is selected. Because of this, the nozzle surfaces can be cleaned without consuming ink from the nozzles. In contrast, when it is determined that the ejection failure nozzle exists, the suction mode is selected. Ink and dusts adhering to the nozzle surfaces and the nozzles are sucked by the suction ports 111. Thereby, cleaning can be performed while the amount of consumed ink from the nozzles is suppressed.

Figure 10:
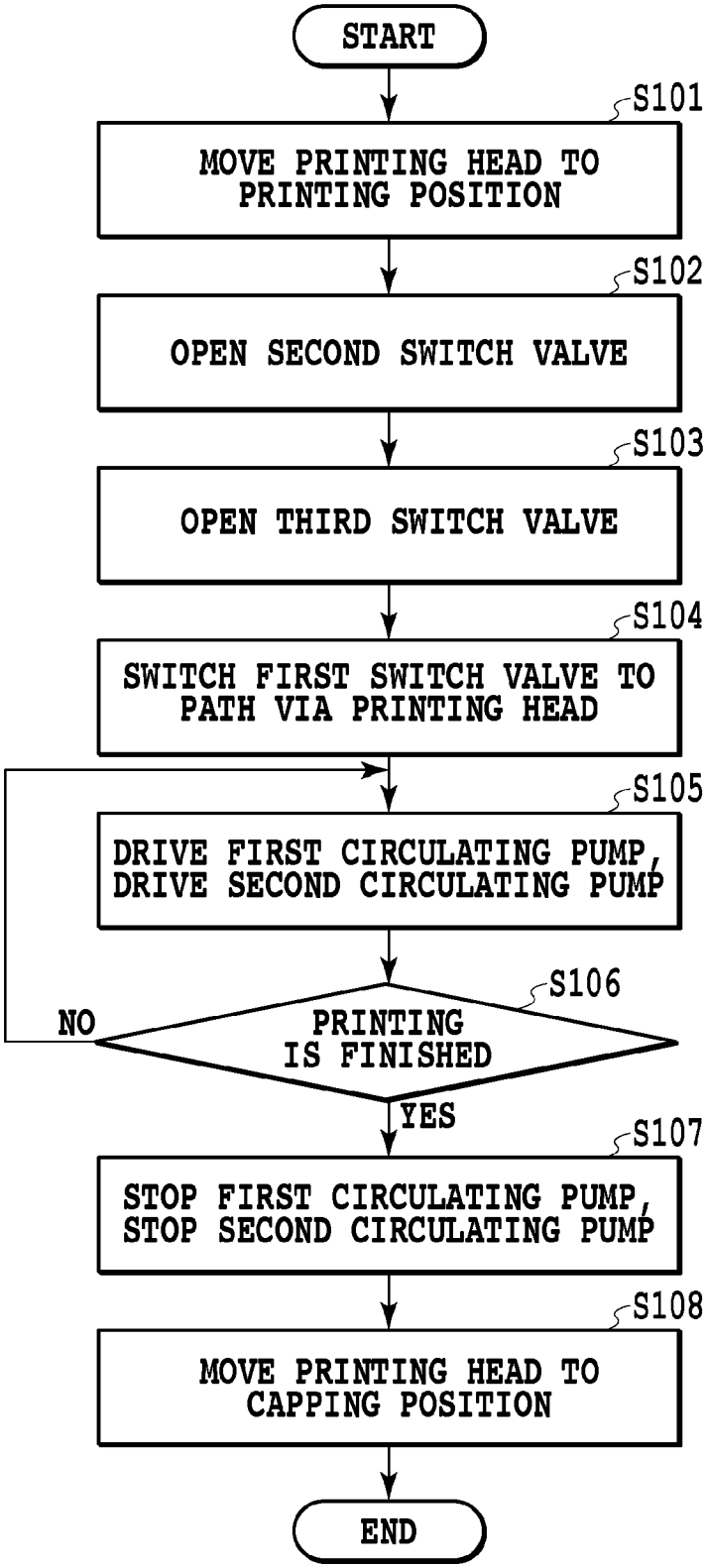
FIG. 10 is flow chart showing a flow of operations at the time of printing in the embodiment.

FIG. 10 is a flow chart showing a flow of operations at the time of printing in the embodiment. At the time of printing, the head holder 5 holding the printing heads 2 moves from a waiting state to a printing position for printing (Step S101). Next, in order to supply ink from the sub tank 10 to the printing heads 2 via the third circulating tube 22 by driving the first circulating pump 11, the second switch valve 39 and the third switch valve 41 are relieved (Step S102 and S103). Furthermore, in order to perform the ink circulating operation in the printing head in-head path 44, the first switch valve 41 is switched to the in-head path 44 (Step S104). The first circulating pump 11 and the second circulating pump 12 are driven, and the ink circulating operation is performed among the buffer tank 8, the sub tank 10 and the printing heads 2, via the in-head path 44 (Step S105). The ink circulating operation continues until printing is finished. When printing is finished (Step S106), driving of the first circulating pump 11 and the second circulating pump 12 is stopped (Step S107). When printing is finished, the printing heads 2 are moved to the capping position (Step S108). By capping the cap 25 and the printing heads 2, drying of the nozzles is suppressed during non-printing. Then, printing is finished.

Through the above-mentioned printing flow, an increase in the temperature of the printing heads 2, which is caused by a continuous printing operation, can be kept within a temperature range in which ejection can be controlled. Moreover, bubbles in the ink path, which occur in the printing operation, can be collected, and a large amount of ink can be circulated and supplied at a certain flow rate while negative pressure in the printing head is stabilized.

Figure 11:
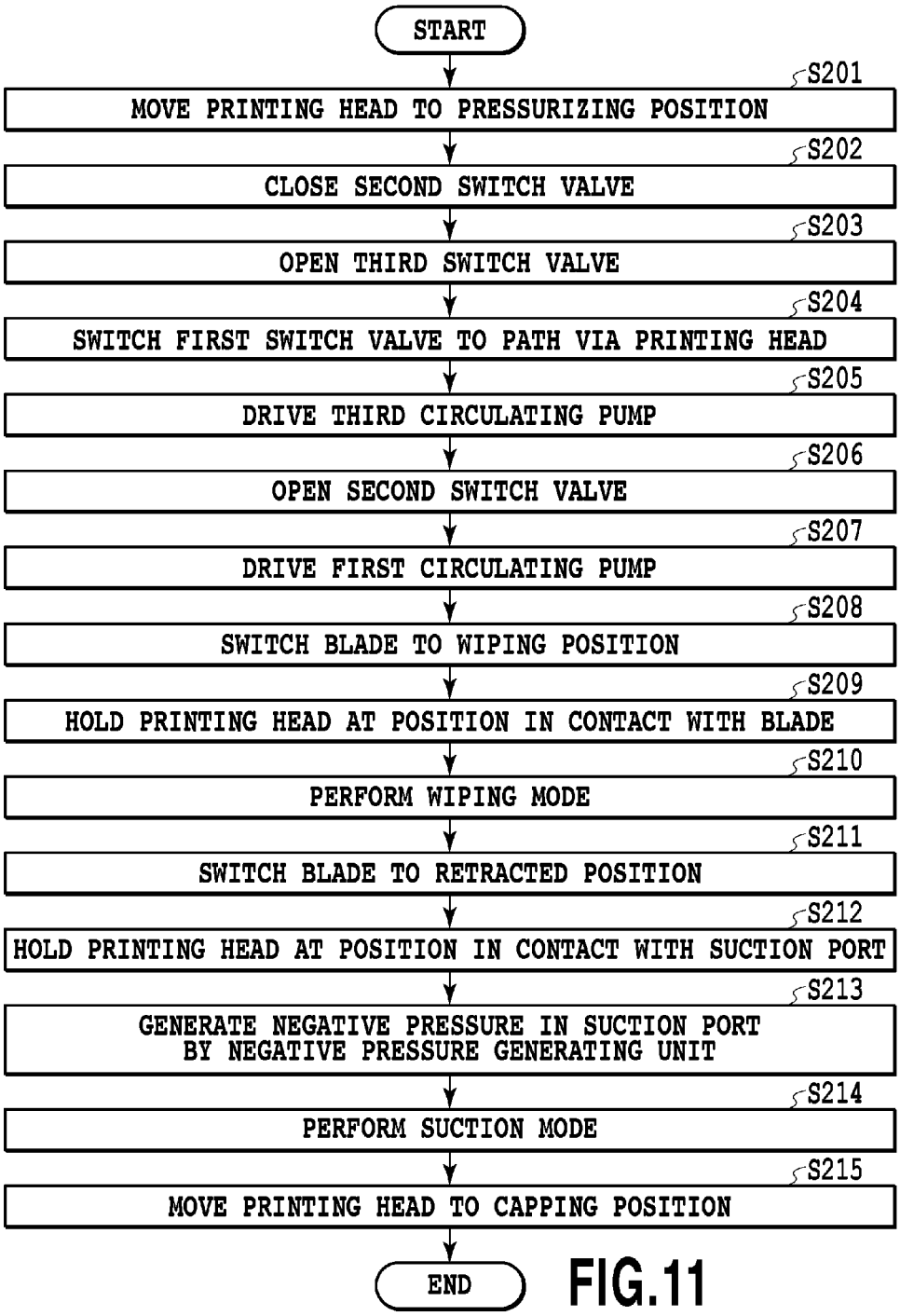
FIG. 11 is flow chart showing operations at the time of maintenance in the embodiment.

FIG. 11 is a flow chart showing operations at the time of maintenance in the embodiment. In the maintenance operation of pressurizing the printing head, in order to perform the pressurizing operation in the printing head, the head holder 5 holding the printing heads 2 is moved to a pressurizing position (Step S201). Next, in order to supply ink from the sub tank 10 to the printing heads 2 via the fourth circulating tube 43 by the third circulating pump 40, the second switch valve 39 is closed (Step S202), and the third switch valve 41 is relieved (Step S203). In order to perform the pressurizing operation in the heads in the in-head path 44, the first switch valve 42 is switched to the in-head path 44 (Step S204). The third circulating pump 40 is driven, the in-head path 44 is put into a pressurized state, and ink is discharged from the ink nozzles 38 to the cap 25 (Step S205). In order to drive the first circulating pump 11 and generate a negative pressure in the in-head path 44 through the third circulating tube 22, the second switch valve 39 is relieved (Step S206). By driving the first circulating pump 11 and generating a negative pressure in the in-head path 44, ink adhering to the nozzle chip surfaces in the pressurizing operation is drawn into the in-head path 44 (Step S207). Next, in order to remove ink adhering to the nozzle chip surfaces and a base substrate, the wiping mode of the blades 121 is performed. In order to perform the wiping mode, as shown in FIG. 9B, the blades 121 are switched to the wiping position (Step S208), and the printing heads 2 are moved to the wiping mode position (Step S209). The wiper unit 146 is moved to the second direction to perform the wiping mode, and the blades 121 wipes out the ink and dusts for removal by wiping the nozzle surfaces and base substrate (Step S210). Next, the suction mode is performed. In order to perform the suction mode, as shown in FIG. 9A, the blades 121 are switched to the retracted position (Step S211), and the printing heads 2 are moved to the suction mode position (Step S212). The wiper unit 146 is moved in the second direction while a negative pressure is generated in the suction ports 111 by the negative pressure generating unit (Step S213) and the suction mode is performed (Step S214). Ink and dusts that adheres to the nozzle chip surfaces and the ink nozzles 38 are sucked by the suction ports 111. In order to suppress drying of the nozzles by capping the cap 25 and the printing heads 2 after completion of the maintenance operation, the printing heads 2 are moved to the capping position (Step S215).

As described above, by driving the first circulating pump 11 after the pressurizing operation, generating a negative pressure in the in-head path 44, and drawing ink adhering to the nozzle chip surfaces into the in-head path 44, ink on the nozzle chip surfaces can be reduced. In addition, by performing wiping after driving of the first circulating pump 11, the number of times of the wiping operation after the pressurizing operation can be decreased, and the durability of the heads can be improved.

Meanwhile, although the tube pump is used as the ink circulating unit in the embodiment, the ink circulating unit of the present invention is not limited to the tube pump. Other pumps may be used as long as they can circulate ink, and any mechanism other than the pump, which is configured to circulate ink, may be adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231275, filed Oct. 21, 2011, which is hereby incorporated by reference herein in its entirety.

What is claimed is:

1. An ink jet printing apparatus comprising:

a printing head having a plurality of nozzles for ejecting ink;

an ink tank storing ink to be supplied to the printing head;

a first pump arranged in a first ink supplying path for supplying ink from the ink tank to the printing head;

a second pump arranged in an ink collecting path for collecting ink from the printing head to the ink tank;

a second ink supplying path configured to supply ink from the ink tank to the printing head;

a switch unit installed between the ink tank and the printing head and configured to switch between a first state where the ink tank is in communication with the printing head through the first ink supplying path and a second state where the ink tank is in communication with the printing head through the second ink supplying path;

a cleaning unit to clean the printing head;

a control unit configured to control the first pump, the second pump, the switch unit, and the cleaning unit; and wherein the control unit is configured to (i) operate the first pump to discharge ink from the printing head with the switch unit in the first state, (ii) operate the second pump to generate a negative pressure in the printing head with the switch unit in the second state, and (iii) operate the cleaning unit to clean the printing head.

2. The ink jet printing apparatus according to claim 1, further comprising a switch valve installed in the ink collecting path, wherein, when printing is performed by ejection of ink from the printing head, the control unit performs control such that the second pump is operated in a state that the switch valve is opened and ink is filled into the printing head.

3. The ink jet printing apparatus according to claim 1, wherein the cleaning unit comprises a suction device for sucking ink from at least a part of the plurality of nozzles, and a blade for wiping the nozzles.

4. The ink jet printing apparatus according to claim 3, wherein the control unit performs maintenance of the printing head such that the nozzles are wiped by the blade and sucked by the suction device.

* * * * *